US010724739B2

(12) United States Patent
Kim et al.

(10) Patent No.: US 10,724,739 B2
(45) Date of Patent: Jul. 28, 2020

(54) COMBUSTOR ACOUSTIC DAMPING STRUCTURE

(71) Applicant: General Electric Company, Schenectady, NY (US)

(72) Inventors: Kwanwoo Kim, Montgomery, OH (US); Owen Graham, Niskayuna, NY (US); Clayton Stuart Cooper, Loveland, OH (US)

(73) Assignee: General Electric Company, Schenectady, NY (US)

( * ) Notice: Subject to any disclaimer, the term of this patent is extended or adjusted under 35 U.S.C. 154(b) by 548 days.

(21) Appl. No.: 15/468,172

(22) Filed: Mar. 24, 2017

(65) Prior Publication Data

US 2018/0274780 A1 Sep. 27, 2018

(51) Int. Cl.
*F23R 3/10* (2006.01)
*F23R 3/00* (2006.01)

(52) U.S. Cl.
CPC ..... *F23R 3/10* (2013.01); *F23R 3/002* (2013.01); *F05D 2240/35* (2013.01); *F05D 2260/964* (2013.01); *F23R 2900/00014* (2013.01)

(58) Field of Classification Search
CPC .. F23R 3/10; F23R 3/002; F23R 2900/00014; F05D 2240/35; F05D 2260/964
See application file for complete search history.

(56) References Cited

U.S. PATENT DOCUMENTS

| | | | | |
|---|---|---|---|---|
| 867,757 | A | 10/1907 | Ruecker | |
| 5,956,955 | A * | 9/1999 | Schmid | F23R 3/283 60/748 |
| 6,546,729 | B2 * | 4/2003 | Hellat | F23M 20/005 431/114 |
| 7,302,802 | B2 | 12/2007 | Alkabie | |
| 7,337,875 | B2 | 3/2008 | Proscia et al. | |
| 7,350,357 | B2 | 4/2008 | Chen et al. | |
| 7,533,534 | B2 | 5/2009 | Alkabie | |
| 7,549,290 | B2 | 6/2009 | Holt et al. | |
| 7,805,943 | B2 | 10/2010 | Desaulty et al. | |
| 7,856,830 | B2 | 12/2010 | Alkabie | |

(Continued)

FOREIGN PATENT DOCUMENTS

| | | | | |
|---|---|---|---|---|
| EP | 2881667 A1 * | 6/2015 | | F23R 3/50 |
| GB | 2515028 | 12/2014 | | |

(Continued)

*Primary Examiner* — Steven M Sutherland
(74) *Attorney, Agent, or Firm* — Dority & Manning, P.A.

(57) ABSTRACT

The present disclosure is directed to a combustor assembly for a gas turbine engine. The combustor assembly includes an annular bulkhead adjacent to a diffuser cavity; a deflector downstream of the bulkhead and adjacent to a combustion chamber; a bulkhead support coupled to an upstream side of the deflector; a first walled enclosure coupled to the bulkhead support; and a second walled enclosure coupled to the first walled enclosure. The deflector and the bulkhead support together define a bulkhead conduit therethrough to the combustion chamber. The first walled enclosure defines a first cavity and a hot side orifice. The hot side orifice is adjacent to and in fluid communication with the bulkhead conduit. The second walled enclosure defines a second cavity and a second opening adjacent to a diffuser cavity.

18 Claims, 4 Drawing Sheets

(56) References Cited

U.S. PATENT DOCUMENTS

| | | | | |
|---|---|---|---|---|
| 7,857,094 | B2 | 12/2010 | Macquisten et al. | |
| 7,926,278 | B2 | 4/2011 | Gerendas et al. | |
| 7,874,159 | B2 | 6/2011 | Gerendas et al. | |
| 8,037,688 | B2 | 10/2011 | Hagen et al. | |
| 8,701,420 | B2 | 4/2014 | Nomura et al. | |
| 8,733,496 | B2 | 5/2014 | Ono et al. | |
| 8,931,588 | B2 | 1/2015 | Murray | |
| 2006/0059913 | A1* | 3/2006 | Bethke | F23R 3/002 60/725 |
| 2008/0202122 | A1* | 8/2008 | Guezengar | F23R 3/002 60/722 |
| 2011/0232288 | A1 | 9/2011 | Bizouard et al. | |
| 2012/0167574 | A1 | 7/2012 | Uskert | |
| 2012/0240583 | A1 | 9/2012 | Penz et al. | |
| 2013/0042627 | A1* | 2/2013 | Gerendas | F23R 3/10 60/782 |
| 2013/0283799 | A1 | 10/2013 | Carey et al. | |
| 2014/0083111 | A1 | 3/2014 | Gregg et al. | |
| 2014/0109591 | A1 | 4/2014 | Bothien et al. | |
| 2014/0245746 | A1 | 9/2014 | Srinivasan et al. | |
| 2015/0021117 | A1 | 1/2015 | Rupp et al. | |
| 2016/0076772 | A1* | 3/2016 | Metternich | F23R 3/18 60/772 |

FOREIGN PATENT DOCUMENTS

| | | | | |
|---|---|---|---|---|
| WO | WO-2013043078 | A1 * | 3/2013 | F23R 3/10 |
| WO | WO 2014/052221 | | 4/2014 | |

* cited by examiner

COMBUSTOR ACOUSTIC DAMPING STRUCTURE

FIELD

The present subject matter relates generally to gas turbine engine combustion assemblies. More particularly, the present subject matter relates to acoustic damping structures for gas turbine engine combustion assemblies.

BACKGROUND

Pressure oscillations generally occur in combustion sections of gas turbine engines resulting from the ignition of a fuel and air mixture within a combustion chamber. While nominal pressure oscillations are a byproduct of combustion, increased magnitudes of pressure oscillations may result from generally operating a combustion section at lean conditions, such as to reduce combustion emissions. Increased pressure oscillations may damage combustion sections and/or accelerate structural degradation of the combustion section in gas turbine engines, thereby resulting in engine failure or increased engine maintenance costs. As gas turbine engines are increasingly challenged to reduce emissions, systems of attenuating combustion gas pressure oscillations are needed to enable reductions in gas turbine engine emissions while maintaining or improving the structural life of combustion sections.

BRIEF DESCRIPTION

Aspects and advantages of the invention will be set forth in part in the following description, or may be obvious from the description, or may be learned through practice of the invention.

The present disclosure is directed to a combustor assembly for a gas turbine engine. The combustor assembly includes an annular bulkhead adjacent to a diffuser cavity; a deflector downstream of the bulkhead and adjacent to a combustion chamber; a bulkhead support coupled to an upstream side of the deflector; a first walled enclosure coupled to the bulkhead support; and a second walled enclosure coupled to the first walled enclosure. The deflector and the bulkhead support together define a bulkhead conduit therethrough to the combustion chamber. The first walled enclosure defines a first cavity and a hot side orifice. The hot side orifice is adjacent to and in fluid communication with the bulkhead conduit. The second walled enclosure defines a second cavity and a second opening adjacent to a diffuser cavity.

In one embodiment, the bulkhead support includes a cavity wall extended toward the deflector. The cavity wall defines the bulkhead conduit between the cavity wall, the bulkhead support, and the deflector.

In various embodiments, the first walled enclosure further defines a cold side orifice adjacent to and in fluid communication with the diffuser cavity. In one embodiment, the first walled enclosure further defines a first cold side walled tube extended into the diffuser cavity from the first cavity.

In another embodiment, the second walled enclosure further defines a second cold side walled tube extended into the diffuser cavity from the second cavity.

In yet another embodiment, the bulkhead conduit defines a substantially cylindrical bore extended through the deflector and the bulkhead support.

In various embodiments, the combustor assembly further includes a mount member coupling the first walled enclosure and the second walled enclosure to the bulkhead of the combustor. In one embodiment, the mount member defines a mechanical fastener.

In one embodiment, the first walled enclosure defines a volume of the first cavity and the bulkhead conduit, and a length of the first cold side walled tube versus a diameter of the cold side orifice, each configured to attenuate pressure oscillations at one or more frequencies.

In another embodiment, the second walled enclosure defines a volume of the second cavity, and a length of the second cold side walled tube versus a diameter of the second orifice, each configured to attenuate pressure oscillations at one or more frequencies.

The present disclosure is further directed to a gas turbine engine including a combustor assembly that includes an annular bulkhead adjacent to a diffuser cavity and upstream of an annular dome assembly adjacent to a combustion chamber. The combustor assembly further includes an acoustic damper. The damper includes a first walled enclosure and a second walled enclosure. The first walled enclosure defines a first cavity and a hot side orifice adjacent to the combustion chamber and the second walled enclosure defines a second cavity and a second opening adjacent to the diffuser cavity. The damper is disposed between the bulkhead and the dome assembly of the combustor assembly.

In one embodiment, the first walled enclosure of the damper further includes a first walled tube extended from the first cavity through the dome assembly. The first walled tube defines a first opening adjacent to the combustion chamber and in fluid communication with the first cavity.

In another embodiment, the dome assembly defines a gap between the first walled tube and the deflector through which a portion of air flows from the diffuser cavity to the combustion chamber.

In yet another embodiment, the second walled enclosure of the damper further comprises a second cold side walled tube extended into the second cavity and/or the diffuser cavity.

In one embodiment, the damper further includes a mount member extended through and coupled to the bulkhead, and further coupled to the first walled enclosure and the second walled enclosure.

In another embodiment, the damper is disposed along the radial direction between a swirler and the bulkhead.

In yet another embodiment, the first walled enclosure of the damper defines a volume of the first cavity, and a length of a first cold side walled tube versus a diameter of the cold side orifice, each configured to attenuate pressure oscillations at one or more frequencies.

In still another embodiment, the second walled disclosure of the damper defines a volume of the second cavity, and a length of the second cold side walled tube versus a diameter of the second orifice, each configured to attenuate pressure oscillations at one or more frequencies.

In various embodiments, the first walled enclosure of the damper further defines a cold side orifice adjacent to and in fluid communication with the diffuser cavity. In one embodiment, the first walled enclosure of the damper further includes a first cold side walled tube extended from the first walled enclosure to the diffuser cavity. The cold side orifice is defined at the first cold side walled tube adjacent to the diffuser cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
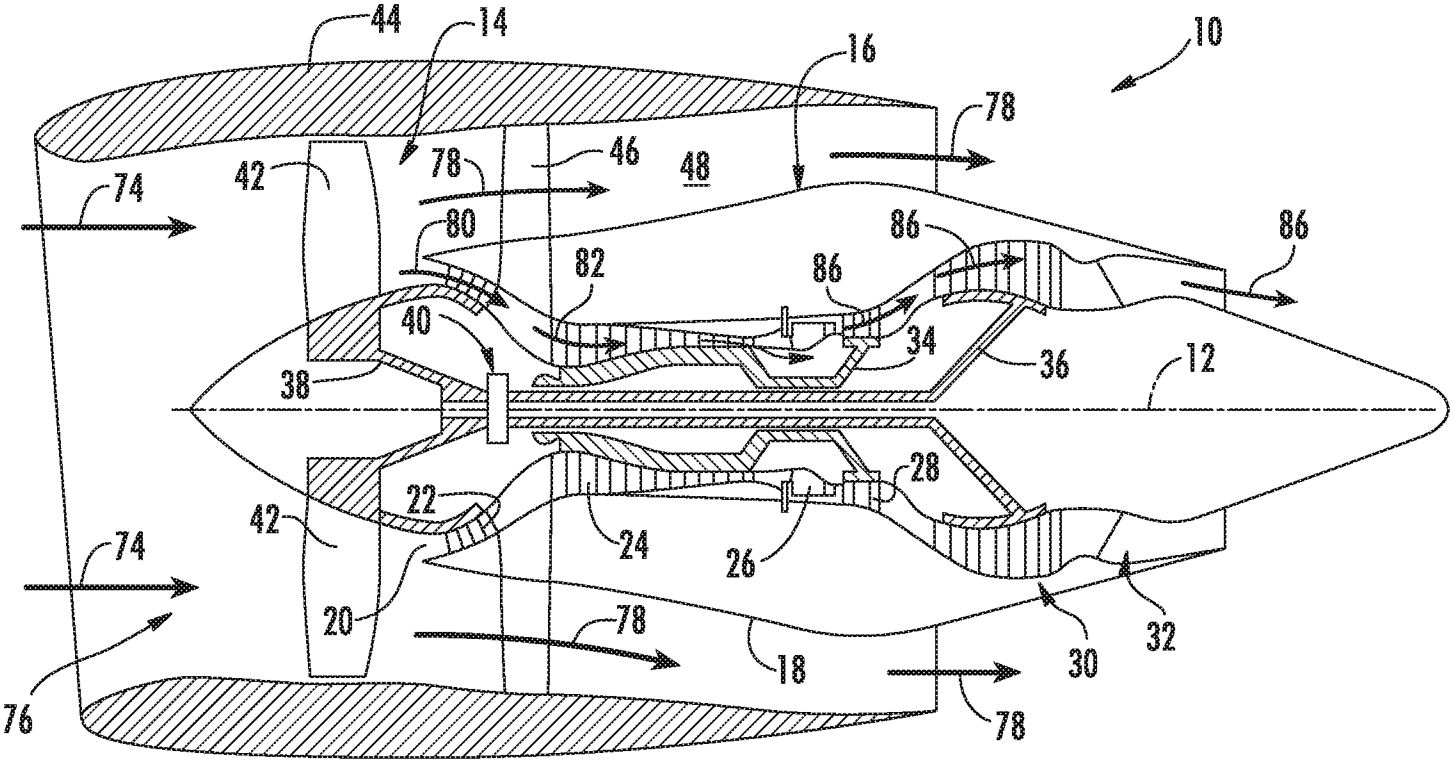
FIG. 1 is a schematic cross sectional view of an exemplary gas turbine engine incorporating an exemplary embodiment of a fuel injector and fuel nozzle assembly.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

An acoustic damper for a combustor assembly for a gas turbine engine is generally provided that may attenuate combustion gas pressure oscillations while maintaining or improving structural life of the combustor assembly, combustion section, and engine. The combustor assembly may define a can annular or annular combustor assembly. The combustor assembly includes an annular bulkhead adjacent to a diffuser cavity, a deflector downstream of the bulkhead and adjacent to a combustion chamber, a bulkhead support coupled to a downstream side of the deflector, and a damper disposed between the bulkhead support and the bulkhead. The damper includes a first walled enclosure coupled to the bulkhead support and a second walled enclosure coupled to the first walled enclosure and defining a second cavity and a second opening adjacent to a diffuser cavity. The first walled enclosure defines a first cavity and a hot side orifice in fluid communication with the combustion chamber.

The combustor assembly including the damper may attenuate pressure oscillations characterized by high pressure fluctuations that are sustained in the hot side (e.g., combustion chamber) and the cold side (e.g., the diffuser cavity) of a combustion section. The damper may mitigate such pressure oscillations by enabling fluid communication of the first walled enclosure with the combustion chamber (e.g., combustion gas pressure within the combustor assembly) while also enabling fluid communication of the second walled enclosure with the diffuser cavity (e.g., compressor exit pressure within the combustor assembly). Damping both the diffuser cavity and the combustion chamber pressure outputs may attenuate pressure oscillations over a broad range of low and high frequencies. Additionally, the damper may be coupled throughout an annulus of the combustor assembly or at select annular locations therein to suppress desired acoustic modal shapes of interest in annular and can annular combustor assemblies.

Referring now to the drawings, FIG. 1 is a schematic partially cross-sectioned side view of an exemplary high bypass turbofan engine 10 herein referred to as "engine 10" as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, the engine 10 has a longitudinal or axial centerline axis 12 that extends there through for reference purposes. The engine 10 defines a longitudinal direction L and an upstream end 99 and a downstream end 98 along the longitudinal direction L. The upstream end 99 generally corresponds to an end of the engine 10 along the longitudinal direction L from which air enters the engine 10 and the downstream end 98 generally corresponds to an end at which air exits the engine 10, generally opposite of the upstream end 99 along the longitudinal direction L. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure compressor and turbine rotatable with an intermediate pressure shaft altogether defining a three-spool gas turbine engine.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
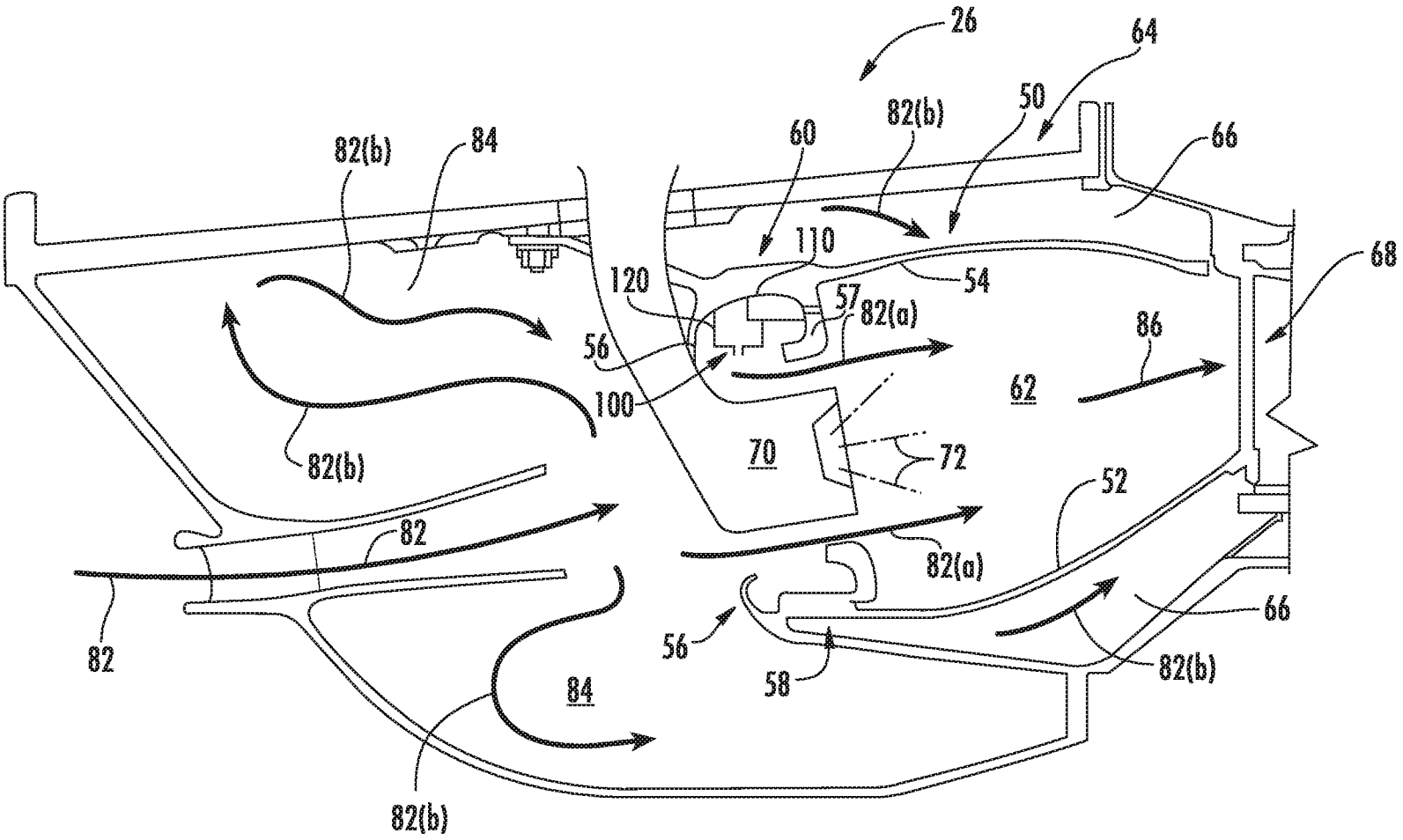
FIG. 2 is an axial cross sectional view of an exemplary embodiment of a combustor assembly of the exemplary engine shown in FIG. 1.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a bulkhead 56 that extends radially between upstream ends 58, 60 of the inner liner 52 and the outer liner 54 respectively. In other embodiments of the combustion section 26, the combustion assembly 50 may be a can-annular type. The combustor 50 further includes a dome assembly 57 extended radially between the inner liner 52 and the outer liner 54 downstream of the bulkhead 56. As shown in FIG. 2, the inner liner 52 is radially spaced from the outer liner 54 with respect to engine centerline 12 (FIG. 1) and defines a generally annular combustion chamber 62 therebetween. In particular embodiments, the inner liner 52, the outer liner 54, and/or the dome assembly 57 may be at least partially or entirely formed from metal alloys or ceramic matrix composite (CMC) materials.

As shown in FIG. 2, the inner liner 52 and the outer liner 54 may be encased within an outer casing 64. An outer flow passage 66 may be defined around the inner liner 52 and/or the outer liner 54. The inner liner 52 and the outer liner 54 may extend from the bulkhead 56 towards a turbine nozzle or inlet 68 to the HP turbine 28 (FIG. 1), thus at least partially defining a hot gas path between the combustor assembly 50 and the HP turbine 28. A fuel nozzle 70 may extend at least partially through the bulkhead 56 and a swirler 65 (shown in FIGS. 3-4) and provide a fuel-air mixture 72 to the combustion chamber 62.

The combustor assembly 50 further includes an acoustic damper 100 disposed between the bulkhead 56, the swirler 65, and the dome assembly 57. The damper 100 includes a first walled enclosure 110 coupled to the dome assembly 57 and a second walled enclosure 120 coupled to the first walled enclosure 110. The first walled enclosure 110 defines a first cavity 111 and a hot side orifice 112 disposed toward or in fluid communication with the combustion chamber 62. The first walled enclosure 110 further includes a first walled tube 114 extended into the diffuser cavity 84 and defining a cold side orifice 113. The second walled enclosure 120 defines a second cavity 121 and a second orifice 122 disposed toward or in fluid communication with a head end portion or diffuser cavity 84. The second walled enclosure 120 further includes a second cold side walled tube 124 extended into the diffuser cavity 84 and/or the second cavity 121 and defining a second orifice 122.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows into the diffuser cavity 84 of the combustion section 26.

The compressed air 82 pressurizes the diffuser cavity 84. A first portion of the of the compressed air 82, as indicated schematically by arrows 82(*a*) flows from the diffuser cavity 84 into the combustion chamber 62 where it is mixed with the fuel 72 and burned, thus generating combustion gases, as indicated schematically by arrows 86, within the combustor 50. Typically, the LP and HP compressors 22, 24 provide more compressed air to the diffuser cavity 84 than is needed for combustion. Therefore, a second portion of the compressed air 82 as indicated schematically by arrows 82(*b*) may be used for various purposes other than combustion. For example, as shown in FIG. 2, compressed air 82(*b*) may be routed into the outer flow passage 66 to provide cooling to the inner and outer liners 52, 54. In addition or in the alternative, at least a portion of compressed air 82(*b*) may be routed out of the diffuser cavity 84. For example, a portion of compressed air 82(*b*) may be directed through various flow passages to provide cooling air to at least one of the HP turbine 28, the LP turbine 30, and through cooling holes in the liners 52, 54.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

As the fuel-air mixture burns, pressure oscillations occur within the combustion chamber 62. These pressure oscillations may be driven, at least in part, by a coupling between the flame's unsteady heat release dynamics, the overall acoustics of the combustor 50 and transient fluid dynamics within the combustor 50. The pressure oscillations generally result in undesirable high-amplitude, self-sustaining pressure oscillations within the combustor 50. These pressure oscillations may result in intense, frequently single-frequency or multiple-frequency dominated acoustic waves that may propagate within the generally closed combustion section 26.

Depending, at least in part, on the operating mode of the combustor 50, these pressure oscillations may generate acoustic waves at a multitude of low or high frequencies. These acoustic waves may propagate downstream from the combustion chamber 62 towards the high pressure turbine 28 and/or upstream from the combustion chamber 62 back towards the diffuser cavity 84 and/or the outlet of the HP compressor 24. In particular, as previously provided, low frequency acoustic waves, such as those that occur during engine startup and/or during a low power to idle operating condition, and/or higher frequency waves, which may occur at other operating conditions, may reduce operability margin of the turbofan engine and/or may increase external combustion noise, vibration, or harmonics.

The first walled enclosure 110 of the damper 100 may attenuate the creation and/or propagation of these acoustic waves and thereby enable stable combustion at reduced emissions, mitigate lean blow out (LBO), facilitate altitude re-light, and preserve structural life of the combustion section 26 and engine 10.

Figure 3:
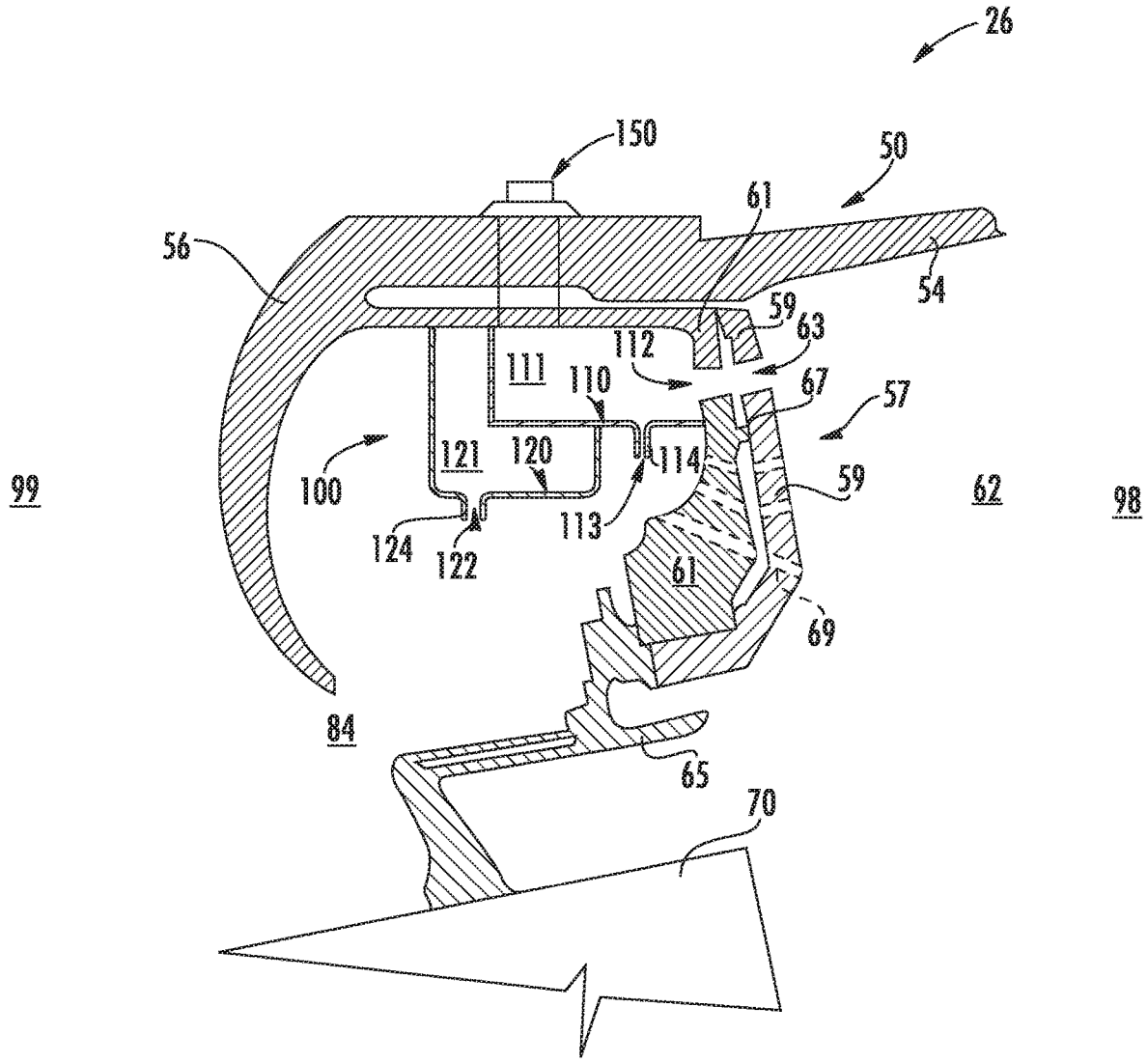
FIG. 3 is a detailed view of a portion of an exemplary embodiment of a combustor assembly.

Referring now to FIG. 3, an exemplary embodiment of the combustor 50 and damper 100 is generally provided in further detail. In the embodiment shown, the dome assembly 57 includes a deflector 59 and a bulkhead support 61. The deflector 59 is downstream of the bulkhead 56 and adjacent to the combustion chamber 62. The deflector 59 is generally a wall, contiguous or segmented, extended at least partially along the radial direction R. The bulkhead support 61 is coupled to an upstream side of the deflector 59. The deflector 59 and the bulkhead support 61 together define a bulkhead conduit 63 extended therethrough to the combustion chamber 62. The hot side orifice 112 of the first walled enclosure 110 is adjacent to and in fluid communication with the bulkhead conduit 63. As such, the first cavity 111 is in fluid communication with the combustion chamber 62 via the hot side orifice 112 and the bulkhead conduit 63. In various embodiments, the bulkhead conduit 63 defines a substantially cylindrical bore extended through the deflector 59 and the bulkhead support 61.

In one embodiment as shown in FIG. 3, the bulkhead support 61 includes a cavity wall 67 extended toward and in contact, or forming a minimal gap, with the deflector 59. The cavity wall 67 defines the bulkhead conduit 63 between the cavity wall 67, the bulkhead support 61, and the deflector 59. The volume of the first cavity 111 and the bulkhead conduit 63 together defined between the cavity wall 67, the bulkhead support 61, and the deflector 59 may be configured to attenuate pressure oscillations from combustion. More specifically, in various embodiments, the volume of the first cavity 111 is sized to attenuate a range of pressure oscillations.

In various embodiments, the first walled enclosure 110 defines a cold side orifice 113 adjacent or proximate to the diffuser cavity 84. The cold side orifice 113 is disposed in fluid communication with the portion of the diffuser cavity 84 between the swirler 65 of the combustor 50, the bulkhead 56, and the dome assembly 57. The first walled enclosure 110 defines a first cold side walled tube 114 extended into the diffuser cavity 84 from the first cavity 111 of the first walled enclosure 110 or into the first cavity 111.

Referring still to FIG. 3, the second walled enclosure 120 may further define a second cold side walled tube 124 extended into the diffuser cavity 84 from the second cavity 121 of the second walled enclosure 120. The second orifice 122 may be defined at an end of the second cold side walled tube 124 and adjacent or proximate to a portion of the diffuser cavity 84 between the swirler 65, the bulkhead 56, and the dome assembly 57.

The cold side walled tube 114 and the second cold side walled tube 124 may each be sized at least partially based on a length over diameter (L/D) related to a target frequency, or range thereof, for the first cavity 111 and second cavity 121, respectively. For example, the cold side walled tube 114 defines a length from the first walled enclosure 110 toward the diffuser cavity 84. The cold side orifice 113 defines a diameter of the cold side walled tube 114. The diameter of the cold side orifice 113 and the length of the cold side walled tube 114 are each defined, at least in part, by a target frequency, or range thereof, of pressure oscillations to attenuate or the volume of the first cavity 111 within the first walled enclosure 110.

As another example, the second cold side walled tube 124 defines a length from the second walled enclosure 120 toward the diffuser cavity 84. The second orifice 122 defines a diameter of the second cold side walled tube 124. The diameter of the second orifice 122 relative to the length of the second cold side walled tube 124 are each defined, at least in part, by a target frequency, or range thereof, of pressure oscillations to attenuate or the volume of the second cavity 121 within the second walled enclosure 120.

In various embodiments, the target frequency, or range thereof, of pressure oscillations of which the first walled enclosure 110 and the second walled enclosure 120 may each be defined by the equation:

$$f = \frac{c}{2\pi}\sqrt{\left(\frac{A}{VL'}\right)}$$

where f is the frequency, or range thereof, of pressure oscillations to be attenuated; c is the velocity of sound in the fluid (i.e., air or combustion gases); A is the cross sectional area of the opening of the bulkhead conduit 63 or second cold side walled tube 124, calculated from the diameter of the hot side orifice 112 or the second orifice 122, respectively; V is the volume of the first cavity 111 defined by the first walled enclosure 110 or the second cavity 121 defined by the second walled enclosure 120; and L' is the effective length of the bulkhead conduit 63 or the second cold side walled tube 124. In various embodiments, the effective length is the length of the bulkhead conduit 63 or the second cold side walled tube 124 plus a correction factor generally understood in the art multiplied by the diameter of the area of the bulkhead conduit 63 or the second cold side walled tube 124, respectively. It should be appreciated that the description herein relates the first cavity 111, the first walled enclosure 110, the bulkhead conduit 63, and the first cold side orifice 113 together to define dimensions for a target frequency, or range thereof, of pressure oscillations. It should further be appreciated that the description herein relates the second cavity 121, the second walled enclosure 120, the second cold side walled tube 124, and the second orifice 122 together to define dimensions for a target frequency, or range thereof, of pressure oscillations.

In various embodiments, the second walled enclosure 120 defines a volume of the second cavity 121 for a range of pressure oscillations. In still various embodiments, the first walled enclosure 110 and the second walled enclosure 120 may each define volumes configured to attenuate pressure oscillations at low and high frequencies induced at various engine 10 and combustor 50 operating conditions.

Referring still to FIG. 2, the damper 100 may further include a mount member 150 coupling the first walled enclosure 110 and the second walled enclosure 120 to the bulkhead 56. In various embodiments, the mount member 150 may define a mechanical fastener, such as, but not limited to, bolts and nuts, screws, tie rods, rivets, pins, etc. In still various embodiments, the mount member 150 may further include a fastening method, such as, but not limited to, welding, soldering, or brazing, or combinations thereof, or in combination with mechanical fasteners.

Figure 4:
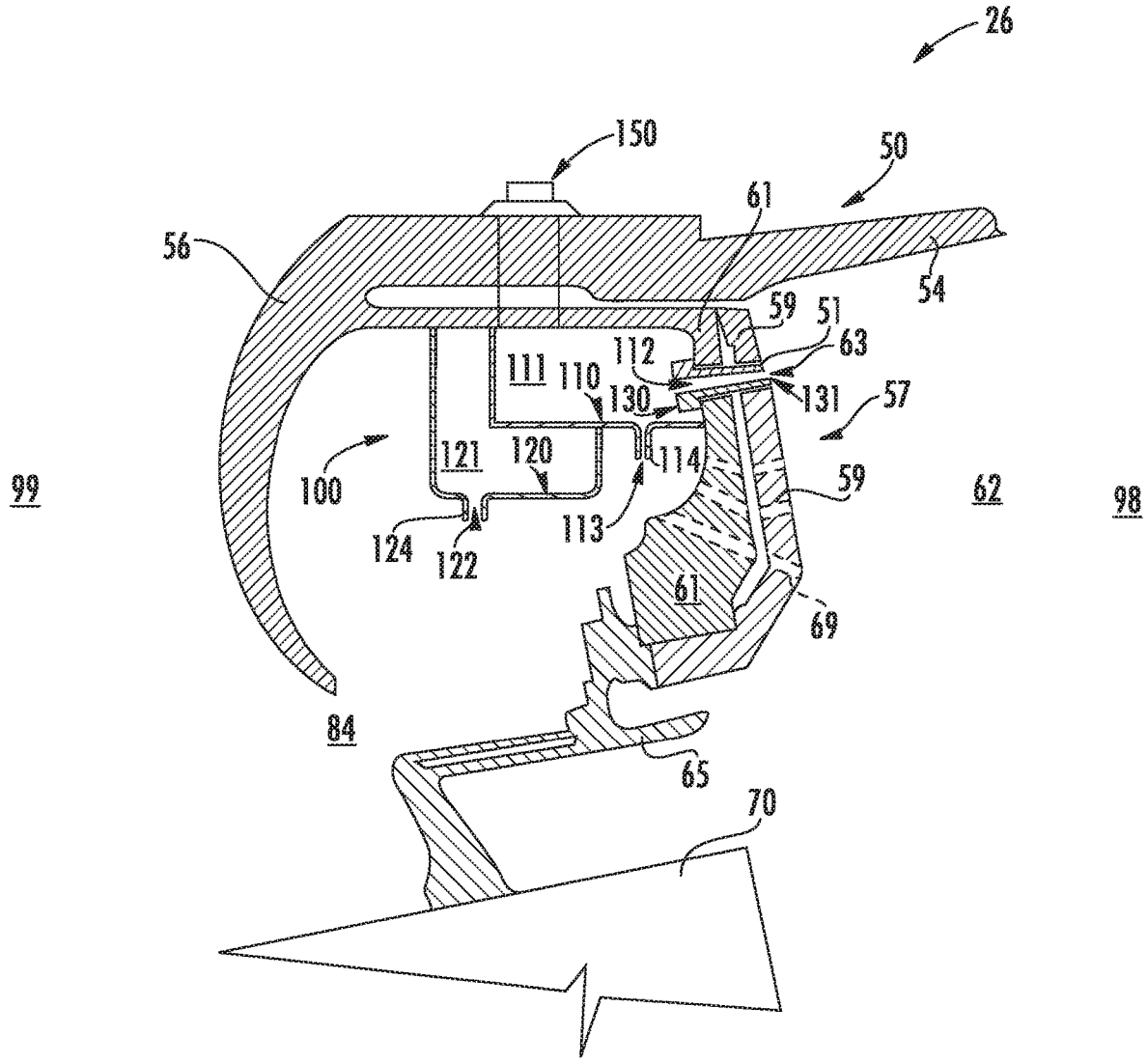
FIG. 4 is a detailed view of a portion of another exemplary embodiment of a combustor assembly.

Referring now to FIG. 4, another exemplary embodiment of the combustor 50 including the damper 100 is generally provided. The embodiment shown and described in regard to FIG. 4 may be configured substantially similarly as described in regard to FIGS. 1-2. However, in FIG. 4 the damper 100 further includes a first walled tube 130 extended from the first cavity 111 of the first walled enclosure 110 through the dome assembly 57. The first walled tube 130 may extend through the bulkhead conduit 63 defined through the bulkhead support 61 and the deflector 59. The first walled tube 130 may further define a first opening 131 adjacent to the combustion chamber 62 and in fluid communication with the first cavity 111 of the first walled enclosure 110. The first walled enclosure 110 may define the hot side orifice 112 adjacent to or proximate with a portion of the first walled tube 130 defined at the first cavity 111. As such, the first walled tube 130 provides fluid communication from the combustion chamber 62 to the first cavity 111 of the first walled enclosure 110 and may enable attenuation of pressure oscillations at low and high frequencies.

The combustor 50 may define a gap 51 between the first walled tube 130 and the dome assembly 57 through which a portion of air from the diffuser cavity 84 may flow to the combustion chamber 62. Additionally, or alternatively, the gap 51 may permit thermal expansion of the dome assembly 57 around the first walled tube 130 extended therethrough. The combustor 50 may further include a plurality of orifices or passages 69 through the bulkhead support 61 and deflector 59 through which a portion of air from the diffuser cavity 84 may flow to the combustion chamber 62, thereby permitting thermal attenuation of the dome assembly.

All or part of the combustor assembly may be part of a single, unitary component and may be manufactured from any number of processes commonly known by one skilled in the art. These manufacturing processes include, but are not limited to, those referred to as "additive manufacturing" or "3D printing". Additionally, any number of casting, machining, welding, brazing, or sintering processes, or any combination thereof may be utilized to construct the damper 100 separately or integral to one or more other portions of the combustor 50, including, but not limited to, the bulkhead 56, the bulkhead support 61, or combinations thereof. Furthermore, the combustor assembly may constitute one or more individual components that are mechanically joined (e.g. by use of bolts, nuts, rivets, or screws, or welding or brazing processes, or combinations thereof) or are positioned in space to achieve a substantially similar geometric, aerodynamic, or thermodynamic results as if manufactured or assembled as one or more components. Non-limiting examples of suitable materials include high-strength steels, nickel and cobalt-based alloys, and/or metal or ceramic matrix composites, or combinations thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine, the combustor assembly comprising:

an annular bulkhead adjacent to a diffuser cavity;

a deflector downstream of the annular bulkhead and adjacent to a combustion chamber;

a bulkhead support coupled to an upstream side of the deflector, wherein the deflector and the bulkhead support together define a bulkhead conduit therethrough to the combustion chamber;

a first walled enclosure comprising a first wall coupled to the bulkhead support, wherein the first walled enclosure defines a first cavity and a hot side orifice, wherein the hot side orifice is adjacent to and in fluid communication with the bulkhead conduit; and a second walled enclosure that comprises a second wall that is not part of the first walled enclosure, that is coupled to the first walled enclosure, and that defines a second cavity and a second opening adjacent to the diffuser cavity, wherein the second walled enclosure further defines a second cold side walled tube extended into the diffuser cavity from the second cavity, and wherein the second cold side walled tube is the only opening of the second walled enclosure.

2. The combustor assembly of claim 1, wherein the bulkhead support comprises a cavity wall extended toward the deflector, and wherein the cavity wall defines the bulkhead conduit between the cavity wall, the bulkhead support, and the deflector.

3. The combustor assembly of claim 1, wherein the first walled enclosure further defines a cold side orifice adjacent to and in fluid communication with the diffuser cavity.

4. The combustor assembly of claim 3, wherein the first walled enclosure further defines a first cold side walled tube extended into the diffuser cavity from the first cavity.

5. The combustor assembly of claim 1, wherein the first walled enclosure defines a volume of the first cavity and the bulkhead conduit, and a length of the first cold side walled tube versus a diameter of the cold side orifice, each configured to attenuate pressure oscillations at one or more frequencies.

6. The combustor assembly of claim 1, wherein the bulkhead conduit defines a substantially cylindrical bore extended through the deflector and the bulkhead support.

7. The combustor assembly of claim 1, further comprising:

a mount member coupling the first walled enclosure and the second walled enclosure to the annular bulkhead of the combustor.

8. The combustor assembly of claim 7, wherein the mount member defines a mechanical fastener.

9. The combustor assembly of claim 5, wherein the second walled enclosure defines a volume of the second cavity, and a length of the second cold side walled tube versus a diameter of a second orifice, each configured to attenuate pressure oscillations at one or more frequencies.

10. A gas turbine engine, the gas turbine engine comprising:

a combustor assembly comprising:

an annular bulkhead adjacent to a diffuser cavity and upstream of an annular dome assembly adjacent to a combustion chamber;

a damper comprising:

a first walled enclosure that comprises a first wall coupled to the annular dome assembly, and a second walled enclosure that comprises a second wall that is not part of the first walled enclosure and that is coupled to the first walled enclosure, wherein the first walled enclosure defines a first cavity and a hot side orifice adjacent to the combustion chamber, wherein the second walled enclosure defines a second cavity and a second opening adjacent to the diffuser cavity, wherein the damper is disposed between the annular bulkhead and the annular dome assembly of the combustor assembly, wherein the first walled enclosure of the damper further comprises a first walled tube extended from the first cavity through the annular dome assembly, and wherein the first walled tube defines a first opening adjacent to the combustion chamber and in fluid communication with the first cavity, and wherein the annular dome assembly defines a gap between the first walled tube and the deflector through which a portion of air flows from the diffuser cavity to the combustion chamber.

11. The gas turbine engine of claim 10, wherein the first walled enclosure of the damper defines a volume of the first cavity, and a length of a first cold side walled tube versus a diameter of a cold side orifice, each configured to attenuate pressure oscillations at one or more frequencies.

12. A gas turbine engine, the gas turbine engine comprising:

a combustor assembly comprising:

an annular bulkhead adjacent to a diffuser cavity and upstream of an annular dome assembly adjacent to a combustion chamber;

a damper comprising:

a first walled enclosure that comprises a first wall coupled to the annular dome assembly, and a second walled enclosure that comprises a second wall that is not part of the first walled enclosure and that is coupled to the first walled enclosure, wherein the first walled enclosure defines a first cavity and a hot side orifice adjacent to the combustion chamber, wherein the second walled enclosure defines a second cavity and a second opening adjacent to the diffuser cavity, and wherein the damper is disposed between the annular bulkhead and the annular dome assembly of the combustor assembly, wherein the second cold side walled tube is the only opening of the second walled enclosure, and wherein the second walled enclosure of the damper further comprises a second cold side walled tube extended into the second cavity and/or the diffuser cavity.

13. The gas turbine engine of claim 12, wherein the first walled enclosure of the damper further comprises a first walled tube extended from the first cavity through the annular dome assembly, and wherein the first walled tube defines a first opening adjacent to the combustion chamber and in fluid communication with the first cavity.

14. The gas turbine engine of claim 12, wherein the damper further comprises a mount member extended through and coupled to the annular bulkhead, and wherein the mount member is coupled to the first walled enclosure and the second walled enclosure.

15. The gas turbine engine of claim 12, wherein the damper is disposed along a radial direction between a swirler and the annular bulkhead.

16. The gas turbine engine of claim 12, wherein the second walled enclosure of the damper defines a volume of the second cavity, and a length of the second cold side walled tube versus a diameter of a second orifice, each configured to attenuate pressure oscillations at one or more frequencies.

17. The gas turbine engine of claim 12, wherein the first walled enclosure of the damper further defines a cold side orifice adjacent to and in fluid communication with the diffuser cavity.

18. The gas turbine engine of claim 17, wherein the first walled enclosure of the damper further comprises a first cold side walled tube extended from the first walled enclosure to the diffuser cavity, and wherein the cold side orifice is defined at the first cold side walled tube adjacent to the diffuser cavity.

* * * * *